US005735715A

United States Patent [19]

Olson

[11] Patent Number: 5,735,715

[45] Date of Patent: Apr. 7, 1998

[54] ELECTRICAL CONNECTOR USING COMPOSITE BEAM WITH LOW INITIAL DEFLECTION RATE

[75] Inventor: Stanley Wayne Olson, East Berlin, Pa.

[73] Assignee: Berg Technology, Inc., Reno, Nev.

[21] Appl. No.: 653,823

[22] Filed: May 28, 1996

Related U.S. Application Data

[63] Continuation of Ser. No. 221,077, Mar. 31, 1994, abandoned, which is a continuation-in-part of Ser. No. 193,443, Feb. 8, 1994, abandoned.

[51] Int. Cl.[6] ..... H01R 13/10

[52] U.S. Cl. ..... 439/682; 439/660

[58] Field of Search ..... 439/682, 691, 439/842, 843, 851, 852, 861, 862, 660, 686

[56] References Cited

U.S. PATENT DOCUMENTS

| | | | |
|---|---|---|---|
| 3,963,293 | 6/1976 | McKee | 439/62 |
| 3,963,317 | 6/1976 | Eigenbrode et al. | 439/267 |
| 4,023,879 | 5/1977 | Braund et al. | 439/862 |
| 4,033,658 | 7/1977 | Asick | 439/862 |
| 4,036,544 | 7/1977 | Keglewitsch | 439/861 |
| 4,306,761 | 12/1981 | Ress, Jr. | 439/862 |
| 4,420,215 | 12/1983 | Tengler | 439/862 |
| 4,775,333 | 10/1988 | Grider et al. | 439/736 |
| 4,871,320 | 10/1989 | Mouissie | 439/78 |
| 5,074,039 | 12/1991 | Hillbish et al. | 29/883 |
| 5,133,679 | 7/1992 | Fusselman et al. | 439/608 |
| 5,151,036 | 9/1992 | Fusselman et al. | 439/108 |
| 5,213,514 | 5/1993 | Arai | 439/79 |
| 5,236,368 | 8/1993 | Adams et al. | 439/79 |
| 5,259,793 | 11/1993 | Yamada et al. | 439/637 |

FOREIGN PATENT DOCUMENTS 879968 1/1959 United Kingdom .

*Primary Examiner*—Hien Vu

*Attorney, Agent, or Firm*—Woodcock Washburn Kurtz Mackiewicz & Norris LLP

[57] ABSTRACT

An electrical connector assembly according to the current invention comprises a receptacle and a composite action beam for electrically connecting a pin to a printed circuit board. The composite action beam is located in the receptacle and has a movable end and a fixed end. During an initial phase of the pin insertion cycle, the movable end of the composite action beam deflects so as to minimize the force necessary to insert the pin into the connector housing. During an intermediate phase of the insertion cycle, the movable end contacts an inside wall of the connector and the composite action beam functions as a two-end supported beam. The composite action beam supported at both ends exerts sufficiently high normal force against the inserted pin so as to retain the pin in the inserted position. Thus, the composite action beam reduces insertion force without compromising normal retention force once the pin is inserted.

5 Claims, 6 Drawing Sheets

ELECTRICAL CONNECTOR USING COMPOSITE BEAM WITH LOW INITIAL DEFLECTION RATE

CROSS REFERENCE TO RELATED APPLICATION

This is a continuation, of application Ser. No. 08/221,077, filed Mar. 31, 1994, now abandoned which is a continuation-in-part of U.S. application Ser. No. 08/193,443, filed Feb. 8, 1994, now abandoned.

FIELD OF THE INVENTION

This invention relates to the field of electrical connectors. More particularly, this invention relates to miniature or high density connectors wherein a relatively low force is necessary to insert a pin in the connector housing for electrical connection to a printed substrate or the like and wherein a spring contact applies a relatively high normal force against the pin for retaining the pin in the connector housing.

BACKGROUND OF THE INVENTION

In electrical connector design, miniaturization has become an increasingly important consideration. However, there is a trade off between connector performance and reduced size. As the size of the connector is reduced, less space is available within the connector for a connector beam. Such a limited space makes it increasingly difficult to provide a low pin insertion force relative to a high normal retention force, while maintaining the desirable tolerances of the connector structure.

In a compact connector, the above-mentioned low insertion force is a significant design factor. As the area required for each pin-to-beam contact is reduced, more contacts may be placed in the connector. Heretofore, more force was necessary for inserting a component within such a connector. Such increased insertion force, particularly where the connector is mounted on a printed circuit board, can result in an unreliable connection, bending of the printed board and solder joint cracking.

Cantilever beams have been used in the art to provide low insertion force. The cantilever beam is generally supported only by one end so that the other end can move during a pin insertion cycle and the beam is thin in order to provide for the necessary deflection. When a pin is initially inserted into a connector housing, the pin touches the movable end of the beam. When the pin is inserted further, the movable end is pushed away in a direction that is substantially transverse to the pin insertion axis to accommodate penetration of the pin. This movement allows low insertion force for an easy insertion. However, when the pin is completely inserted into the connector, such a thin cantilever beam does not apply a desirably high normal force against the inserted pin in order to retain the pin in the connector housing.

On the other hand, a supported beam provides high normal force against a completely inserted pin. Since the supported beam is generally supported by both ends, unlike a cantilever beam, either end of the supported beam does not move. During the pin insertion cycle, the supported beam only deflects. Accordingly, the supported beam tends to require high insertion force during an initial phase of an insertion cycle. Since a compact connector assembly may accommodate a large number of contacts, the total amount of necessary insertion force is undesirably high.

Thus, neither a cantilever beam nor a supported beam alone may be appropriate for a compact connector. A cantilever beam may require low initial insertion force, but it may provide sufficient normal retention force against a completely inserted pin. A cantilever beam also requires a larger space for the movable end. A supported beam, on the other hand, may provide sufficient normal force against an inserted pin, but requires large insertion force during an initial phase of an insertion cycle. Accordingly, a large number of pins cannot be placed on the same connector with supported beams due to the larger insertion force.

Thus, there is a need for an electrical connector wherein a relatively low force is necessary to insert a pin in the connector housing for electrical connection to a printed substrate or the like and wherein a spring beam contact applies a relatively high normal force against the pin for retaining the pin in the connector housing. The present invention provides an electrical connector which satisfies this need.

SUMMARY OF THE INVENTION

Accordingly, the current invention provides a compact electrical connector with low insertion force relative to high normal retention force, while allowing for desired tolerances in the connector structure. Thus, one object of the current invention is to limit height, width and pitch of a connector. Another object is to provide low insertion force at least during an initial phase of an insertion cycle. Yet another object of the current invention is to provide high normal force against the inserted pin in order to retain the pin within the connector housing. Lastly, another object of the invention is to provide the ability to maintain desirable tolerances during all phases of the manufacture and use of the connector.

According to one aspect of the current invention, an electrical connector assembly for electrically connecting a pin comprises a receptacle having a bore along a pin insertion axis, the bore having inner walls, and a composite action beam located in the bore for providing a substantially low insertion force or low spring rate during the initial phase of insertion of the pin and providing a substantially high normal force against the pin during a later phase of the insertion.

According to another aspect of the current application, the composite action beam has a unsupported end and a supported end. The composite action beam provides a substantially low deflection rate at the unsupported end during an initial phase of insertion, and the composite action beam functions as a cantilever beam during the initial phase. The unsupported end is abutted against one of the inner walls during a later phase of the insertion, the composite action beam then functioning as a supported beam, thus providing a substantially high normal retention force against the pin.

According to a third aspect of the invention, an electrical connector for electrically connecting a pin having a central pin axis, comprises a housing having a top and bottom surface, an insertion bore defining an insertion surface and a spring retention bore defining a retention surface. The insertion bore is in communication with the spring retention bore and the insertion surface is substantially aligned with the retention surface. The insertion bore has a central insertion axis and the housing further has a cavity formed in the bottom surface. A retention spring is disposed within a receptacle and the receptacle is disposed within the housing cavity and is mechanically connected to the housing such that the receptacle is retained in the housing and the retention spring extends into the spring retention bore. The pin is inserted into the insertion bore with the central pin axis being substantially coincidental with the central insertion axis and the retention spring electrically contacts the pin and retains the pin against the retention surface.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

DETAILED DESCRIPTION OF THE PREFERRED EMBODIMENT(S)

Figure 1A:
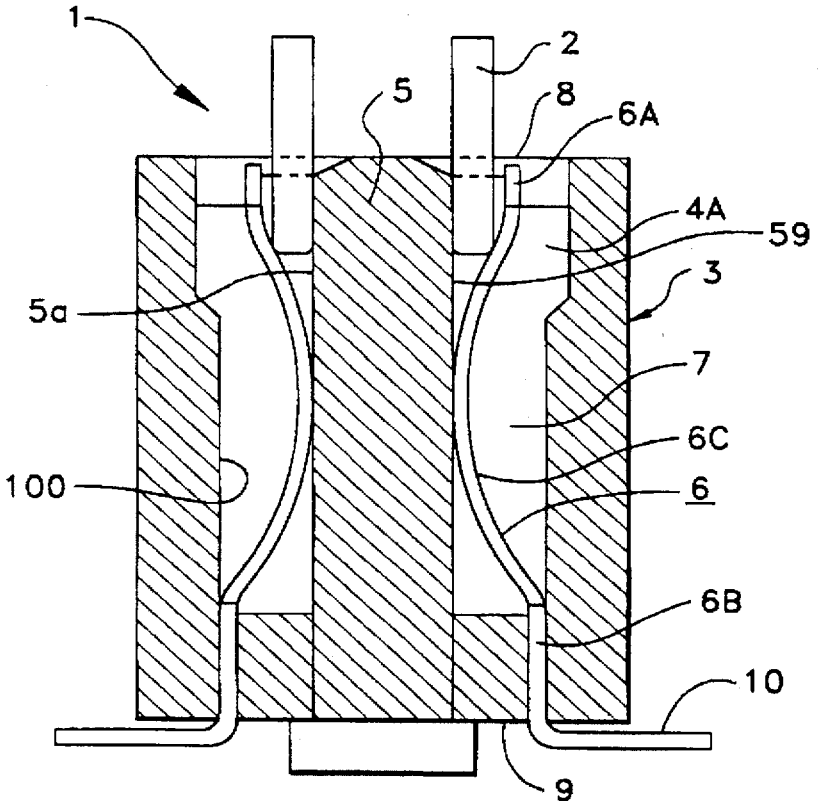
FIG. 1A diagrammatically illustrates a cross-section of a preferred embodiment of a miniature connector and a pin according to the current invention during an initial phase of an insertion cycle.

Referring now to the drawings, wherein like reference numerals designate corresponding structure throughout the views.

FIG. 1A shows a cross sectional view of one preferred embodiment of a compact connector assembly according to the current invention. The assembly 1 comprises a pin 2 and a compact connector or receptacle 3. The compact connector 3 further comprises a side wall 4, sidewall inner surface 100, an insertion wall 5 and an electrically-conductive composite action beam 6. The composite action beam 6 is located in a bore 7 which is limited by the insertion wall 5 and inner wall 100 of the sidewall 4. The insertion wall 5 has two insertion surfaces 5*a* that are in communication with an adjacent bore. A movable or unsupported end 6A of the composite action beam 6 is located near a pin receiving opening 8 while a fixed or supported end 6B of the composite action beam 6 is located near a solder tail opening 9. A solder tail 10 of the composite action beam 6 is continuous with the composite action beam 6 at the fixed end 6B and protrudes through the solder tail opening 9. The solder tail 10 bends 90° around a bottom of the sidewall 4 and extends horizontally beyond the sidewall 4.

Still referring to FIG. 1A, the movable end 6A makes a contact with the pin 2 during an initial phase of an insertion cycle. The angle of attack by the pin 2 with respect to the movable end 6A may be relatively high during this initial phase, compared to later phases of the insertion cycle. In a preferred embodiment, the movable side 6A is located to one side of the pin receiving opening 8 during this phase of insertion. The center of arch 6C of the composite action beam 6 can abut against the insertion surface 5*a*. The pin-receiving opening 8 can be partially further indented on a surface 4A facing the movable end 6A. The deflection rate during the initial phase can be approximately 4 gram per mil according to a preferred embodiment of the current invention. The movable end 6A functions as a cantilever beam and requires low insertion force during this initial phase.

Figure 1C:
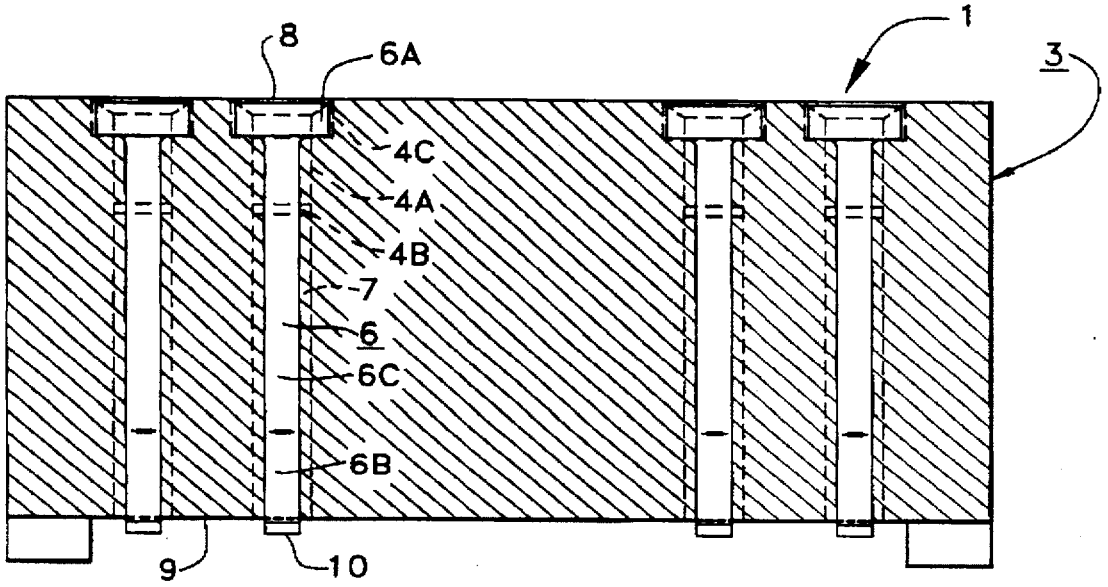
FIG. 1C shows another cross-sectional view of the miniature connector at 1C—1C of FIG. 1B.
Figure 1B:
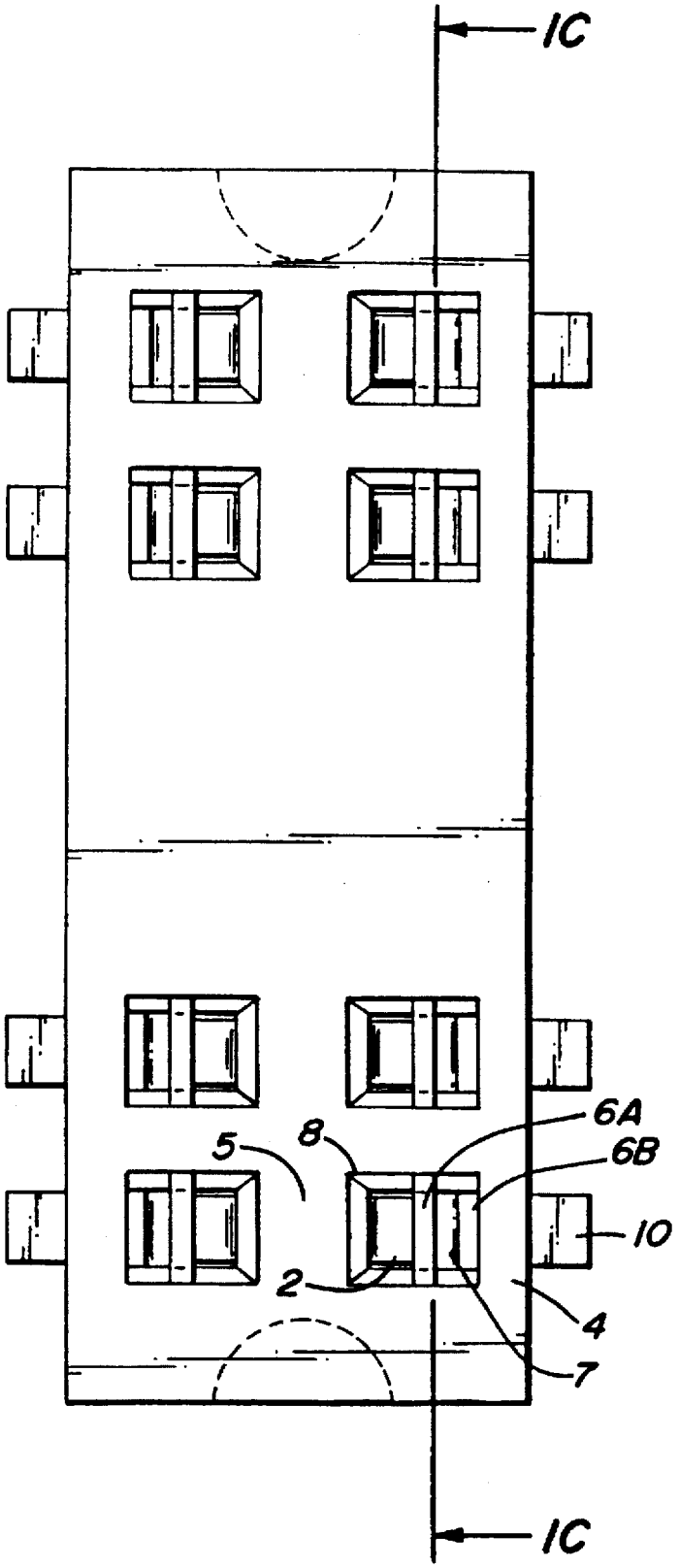
FIG. 1B diagrammatically illustrates a top view of the miniature connector of the current invention.

Now referring to FIG. 1B, relative locations of the above discussed components in the compact connector according to the current invention are shown in a top view. In a pin-receiving opening 8, the pin 2 is shown in the most inner part against the inner wall 5. The pin 2 contacts the movable end 6A of the composite action beam 6 in an approximately center location of the pin receiving opening 8. Lateral to the movable end 6A is a space 7 and the fixed end 6B which abuts the sidewall 4. Further lateral to the sidewall 4 is a portion of the solder tail 10, which extends beyond the sidewall 4. In the embodiment shown in FIG. 1B, there are eight pin-to-beam contacts on the connector. It is noted, however, that such a connector feature would most likely be applicable in high pin count configurations.

FIG. 1C shows another cross-sectional view of the miniature connector at 1C—1C of FIG. 1B. The pin-receiving opening 8 has a larger diameter than the width of the composite action beam 6. The bore 7 indicated by a dotted line is limited by the inside walls of the connector 3. The composite action beam 6 shown in solid line has the movable end 6A near the pin-receiving opening 8, the arch portion 6C near the center of the bore 7 and the fixed end 6B near the solder tail opening 9. The solder tail 10 is contiguous with the fixed end 6B. The indented surface 4A further comprises a transition area 4B between the indented surface 4A and the inner surface of the side wall 4. The indented surface further comprises movable area 4C where a movement of the movable end 6A of the composite action beam 6 is accommodated. Thus, the movable end of the composite action beam 6 is guided within movable area 4C of the indented surface 4A so as to minimize the deviation from a predetermined course of movement. In a preferred embodiment, the width of the movable end 6A and the corresponding moveable area 4C is wider than the rest of the composite action beam 6 or the bore 7. This width differentiation prevents the moveable end 6A of the composite action beam from being pushed down towards the fixed end 6B so as to maintain its substantially horizontal movement near the pin-receiving opening 8 during the pin insertion cycle.

It will be noted in FIG. 1A, that solder tail opening 9 is filled. In such a construction it may not be necessary to provide movable end 6A with a portion that is wider than the composite action beam 6 or bore 7. Similarly, if movable end 6A is constructed as shown, it may not be necessary to fill solder tail opening 9. One advantage to filling solder tail opening 9 is the prevention of solder from flowing into bore 7 during mounting of the connector.

Figure 2:
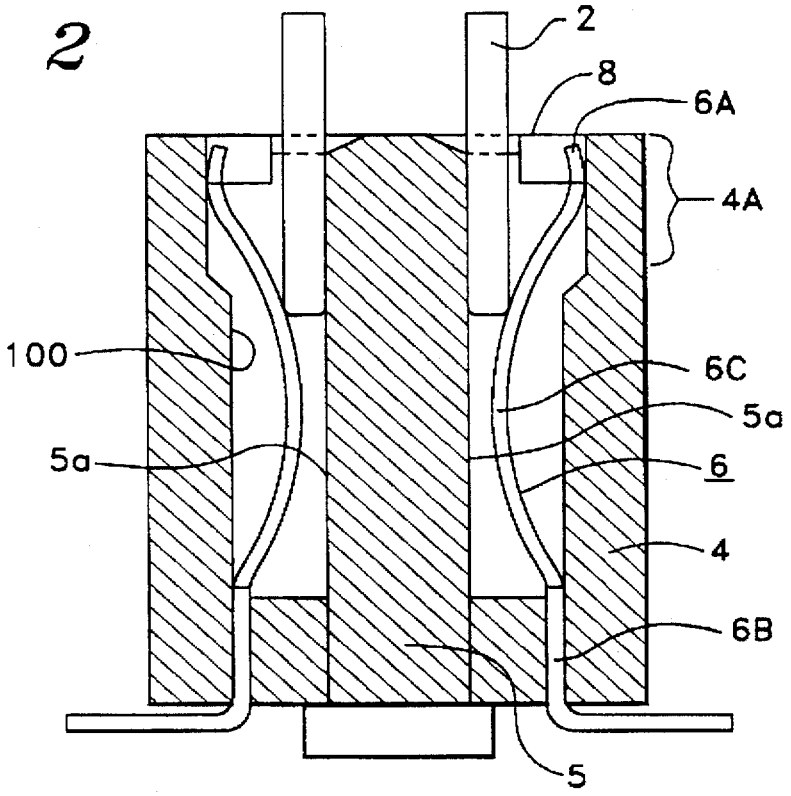
FIG. 2 shows a cross-sectional view of the miniature connector as in FIG. 1A and a pin during an intermediate phase of the insertion cycle.

FIG. 2 illustrates an intermediate phase of the pin insertion cycle in a preferred embodiment according to the current invention as shown in FIG. 1A. The pin is further inserted towards the center of the arch 6C of the composite action beam 6. To accommodate further insertion, the movable end 6A functions as a cantilever beam, and the movable end 6A moves towards the partially indented surface 4A of the sidewall 4. The partially indented surface 4A of the sidewall 4 can serve to narrow the overall width of the connector assembly 1. The movable end then abuts against the partially intended surface 4A as shown in FIG. 2. At this point, the composite action beam 6 goes through a transition from a cantilever beam to a supported beam. Neither end of the composite action beam 6 no longer horizontally moves to accommodate further pin insertion. However, the center of the arch 6C deflects from this point on. As the center of the arch 6C deflects, the movable end 6A may move in the direction of an axis of insertion toward the pin receiving opening 8. The fixed end 6B of the composite action beam 6 remains stationary with respect to the sidewall 4. Accordingly, the deflection rate may increase up to approximately 16 grams per mil after the composite beam 6 acts as a two-point supported beam in a preferred embodiment of the current invention.

Figure 3:
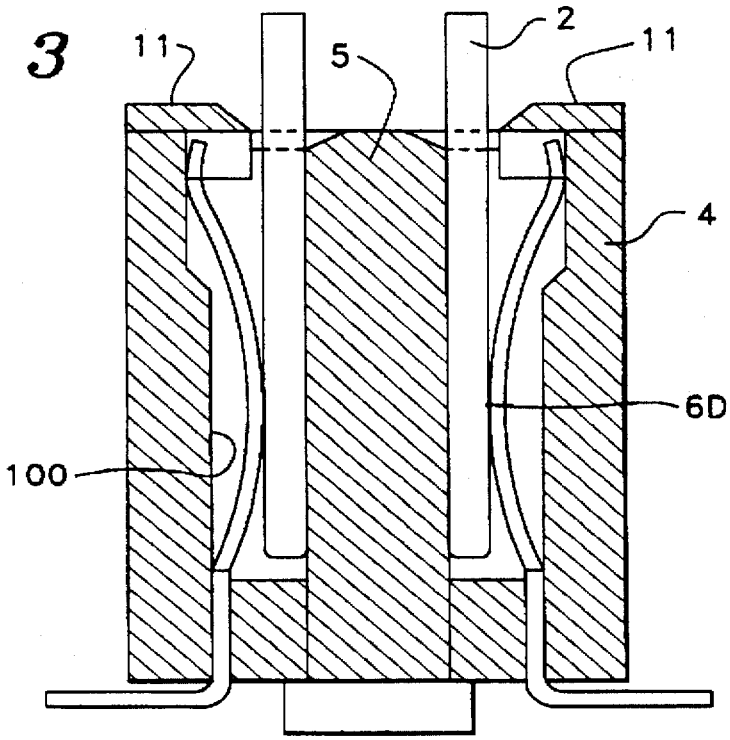
FIG. 3 illustrates a cross-sectional view of the miniature connector and the pin of the current invention as in FIG. 1A after the pin is completely inserted into the connector.

Now referring to FIG. 3, the pin 2 has reached the final insertion point. The pin 2 is pressed against the insertion surface 5*a* by the composite action beam 6 at a Hertzian stress dot 6D. In this final insertion phase, the composite action beam 6 provides high normal force against the pin 2 relative to initial insertion force so as to retain the pin 2 in the final position. The composite action beam 6 now remains to function as a two-point supported beam.

It will also be noted that an anti-stubbing top 11 has been added to connector 1 which extends over pin receiving opening 8. The function of top 11 is to prevent stubbing of pins 2 on composite beam 6. In order to assist in the insertion of pins 2, the end portion of top 11 extending over pin receiving opening 8 is chamfered or tapered.

In summary, FIGS. 1–3 illustrate a transition of the composite action beam 6 from a cantilever beam to a supported beam. Such a transition in the beam 6 yields low insertion force during an initial phase relative to high normal force against a completely inserted pin. Low insertion force is an advantage for a compact connector. Since the area required for each pin-to-beam contact is smaller with the composite action beam of the current invention, a larger number of the contacts may be placed in the compact connector. Thus, a total amount of insertion force needs to be kept minimal so as to make insertion relatively easy and reliable. The composite action beam of the current invention satisfies such a low insertion force requirement. At the same time, when a pin is completely inserted, sufficiently high normal force against the pin is also provided by the composite action beam of the current invention. Therefore, the composite action beam of the current invention combines the advantageous features of the cantilever beam and the supported beam without sacrificing the space limitation of a compact connector.

Figure 4:
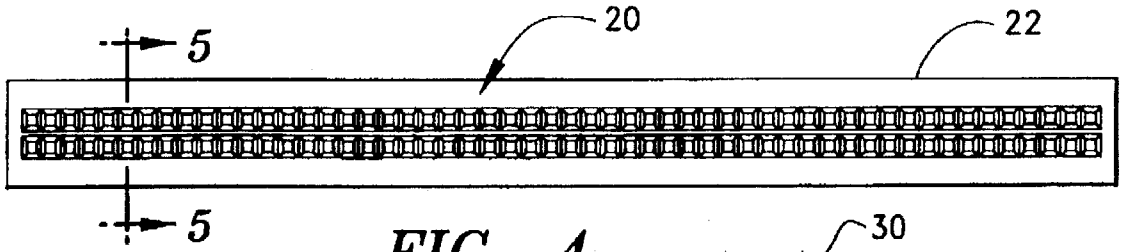
FIG. 4 shows a top view of a further embodiment of an electrical connector in accordance with the present invention.
Figure 5:
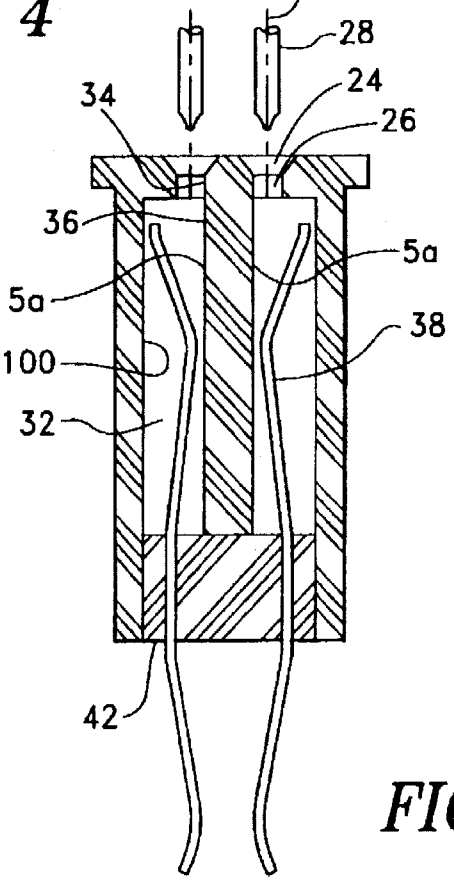
FIG. 5 shows a cross-sectional view taken along the lines 4—4 of the electrical connector of FIG. 4.

Another embodiment of an electrical connector in accordance with the present invention is shown in FIGS. 4 and 5. In this embodiment, adjacent pin insertion openings 20 in the connector receptacle 22 are closely spaced together, both in the longitudinal and lateral direction. A counter-sink bore 24 of each pin insertion opening 20 is in communication with an insertion bore 26 such that the counter-sink bore facilitates easy insertion of adjacent pins 28 into the insertion bores 26 of laterally adjacent pin insertion openings 20. Pin 28 and the counter-sink bore 24 and insertion bore 26 all have a coincidental central axis 30 such that the pins 28 are inserted into the openings 20 along the central axis 30. The insertion bores 26 are only slightly larger than, and preferably the same shape as, the external surface of the pins 28, taking into account the necessary tolerances of the structure.

The insertion bore 26 of each opening 20 is in communication with a spring retention bore 32 in the receptacle, with the central axis of the spring retention bore being parallel to, but displaced from, the axis of insertion of the pins along central axis 30. An insertion wall 100 is between each insertion bore 26 and beam retention bore 32. A surface 34 of the insertion bore 26 is substantially aligned with a surface 36 of the spring retention bore 32 such that the pins 28 are inserted into the spring retention bore closely adjacent to, and preferably contacting, the surface 36 of the spring retention bore 32. The pins 28 are thus inserted into contact with the contact beams 38 in the manner described above such that the pins are retained against the surface 36. In this manner, the tolerances of the assembly can be low, while ensuring that the pins contact a wall of the housing when the contact beam applies a high normal force in order to retain the pins in the housing.

Figure 6A:
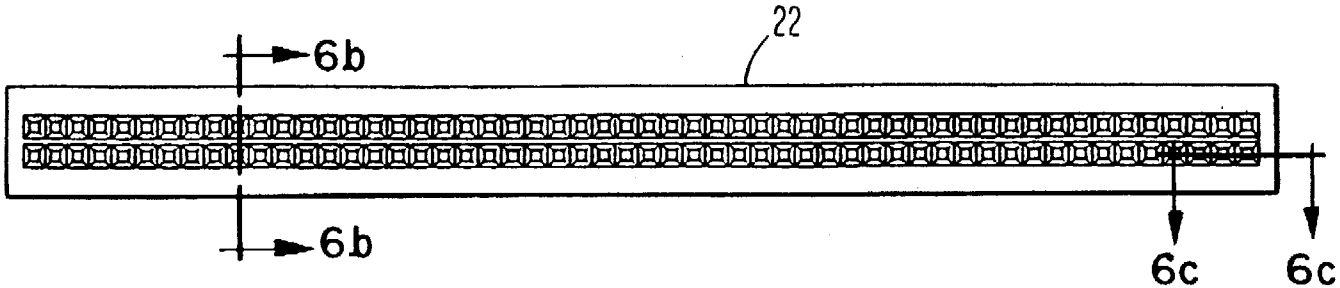
FIG. 6*a* shows a top view of an embodiment of a connector housing in accordance with the present invention.
Figure 6C:
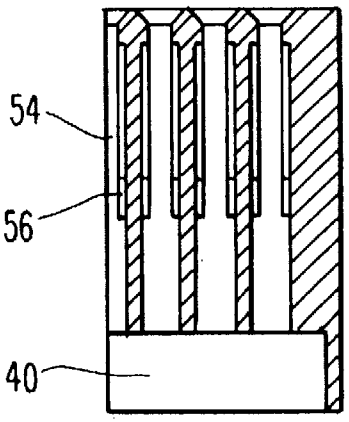
FIG. 6*c* shows a partial longitudinal cross-sectional view taken along the lines 6*c*—6*c* of the connector housing of FIG. 6*a*.
Figure 6B:
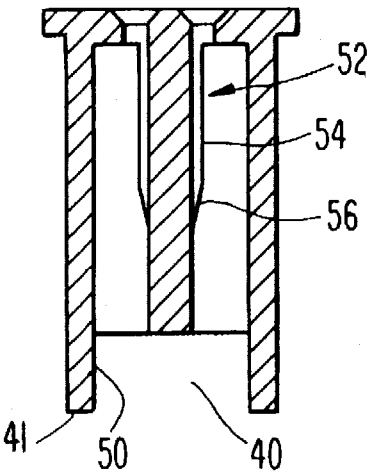
FIG. 6*b* shows a lateral cross-sectional view taken along the lines 6*b*—6*b* of the connector housing of FIG. 6*a*.
Figure 7A:
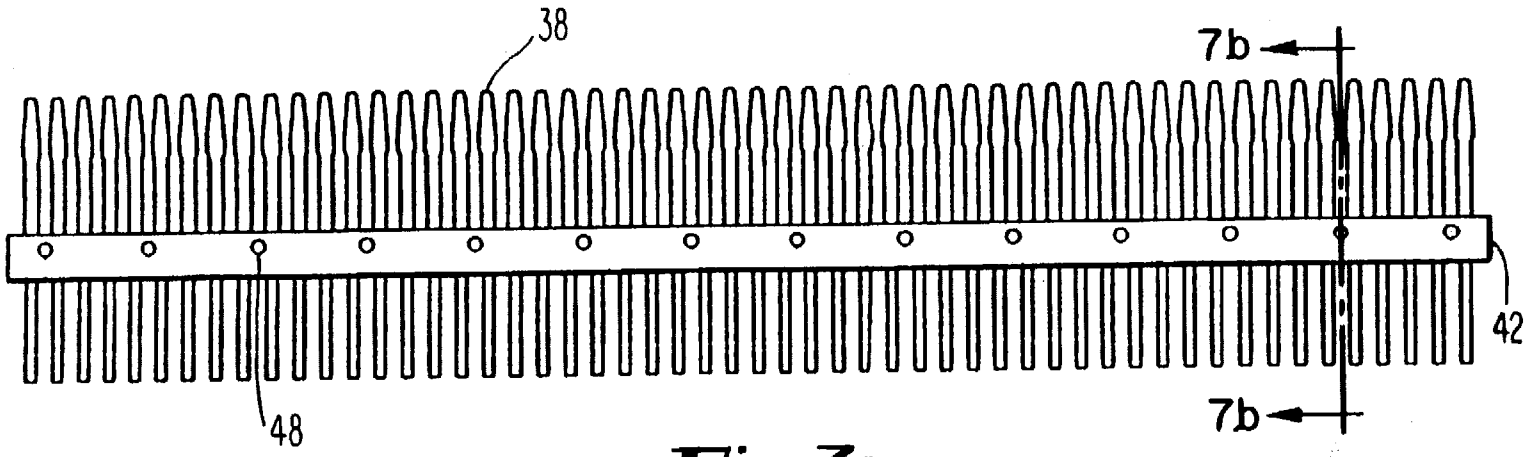
FIG. 7*a* shows a receptacle and retention spring assembly in accordance with the present invention.
Figure 7B:
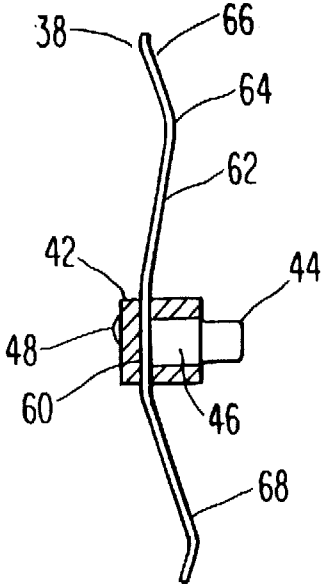
FIG. 7*b* shows a cross-sectional view taken along the lines 7—7 of the receptacle and retention spring assembly of FIG. 7*a*.

Referring to FIGS. 6*a*–6*c* , wherein an embodiment of the connector receptacle is shown without the contact beams, the connector receptable 22 has a cavity 40 in the bottom surface 41. Referring to FIG. 5, the contact beams 38 are mounted in a receptacle 42 such that the contact beams are detachably mounted within the receptable when the insertion member 42 is mounted into the cavity 40. As shown in FIGS. 7*a*–7*b*, in a preferred embodiment, one row of contact beams is disposed in one half of a insertion member 42. In such an embodiment, each half of the insertion member 42 includes alternating pins 44 and holes 46, which are preferably square. In this manner, these rows of contact beams are easily manufactured separately and subsequently assembled together with the pins of one row connected into a corresponding hole of another row in a known manner to form a single receptacle having adjacent rows of contact beams. Accordingly, the rows of adjacent contact beams are inserted into the spring retention bore and detentes 48 on the insertion member 42 engage the walls 50 of the connector receptacle, causing elastic deformation of the walls in the area of the detentes, such that the insertion member is mechanically connected to the connector receptacle.

Referring to FIGS. 6*b*–6*c*, in order to facilitate insertion of the contact beam rows into the receptacle, in a preferred embodiment connector receptacle 22 includes beam insertion ramps 52. These ramps comprise a flat portion 54, extending from the base of the insertion bore, and a sloped portion 56 which extends toward the bottom surface 41 of the connector receptacle. Upon insertion of the contact beams in the spring retention bore, the contact beams slide up the sloped portion 54 and onto the flat portion 56 such that all of the insertion tolerances are applied to one side of the connector receptacle and can be accounted for during manufacture of the connector structure. It should be noted that in this embodiment a small additional insertion force on the pins 28 will be necessary to insert the pins into the receptacle, since the insertion ramps 52 impart a small load on the contact beams as they come into contact with the surface 36 of the connector receptacle in the spring retention bore.

A preferred embodiment of a contact beam 38 is shown in FIG. 7*b*. A straight portion 60 is disposed within the insertion member 42. Preferably, the straight portion 60 is molded into the insertion member during the manufacture of the beam and receptacle assembly such that solder used to mount the contact beam to a printed substrate cannot flow from the bottom of the connector receptacle and into the spring retention bore. Another straight portion 62 extends at an angle from one end of the straight portion 60. The straight portion 62 is joined to a curved contact portion 64 and the curved contact portion 64 is joined to top portion 66. The end of the contact beam including the straight portion 60 and curved contact portion 64 is the end that is inserted into the spring retention bore, as shown in FIG. 5. Accordingly, when the pins 28 are inserted into the openings 20 of the housing 22 they contact the curved contact portion 64 of the contact beam 38 and the top portion 66 of the beam deflects away from the surface 36. When the pins 28 are fully inserted into the spring retention bore, the curved contact portion of the contact beam applies a high normal force against the pins for retaining the pins in the housing in the manner described above.

The mounting portion 68 of the contact beam extends from the other end of straight portion 60. In the embodiment shown, mounting portion 68 is for straddle mounting of the connector wherein the mounting portion of the contact beam in the adjacent rows of beams is soldered to a pad on either side of a printed circuit board or the like in a known manner. However, the present invention is not intended to be limited in this manner and a known mounting portion for surface mounting the connector is within the scope of the invention.

It is to be understood that, even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An electrical connector for electrically connecting at least two pins, said connector comprising:

a receptacle having a top and bottom surface and at least two beam retention bores with an middle wall therebetween, said middle wall having two opposing insertion surfaces, each bore having a corresponding axis, each bore adapted for receiving a corresponding pin, each one or said bores having an inner wall opposite said insertion surface, wherein at least one of said inner walls has a partially indented surface, said housing further having at least one cavity formed in said bottom surface in communication with said two bean retention bores; and a first contact beam and a second contract bean, said first contract beam and second contact beam each having a first end disposed within an insertion member and a second end extendingly disposed within a corresponding beam retention bore, said insertion member fit in said cavity and mechanically connected to said receptacle such that said insertion member is retained in said receptacle, said first and second contact beams each having unsupported end and a supported end and a curved arc between said support end and unsupported end, said curved arcs extending towards each other and against each respective insertion surface, such that when pins are inserted into respective bores at said unsupported ends during an initial phase of an insertion, each of said contact beams functioning as a cantilever beam so as to allow a substantially low deflection rate and low pin insertion force during said initial phase, further insertion of the pins causing said unsupported ends to reach said inner walls and to slide along said inner walls during later phase of said insertion, thereby retaining said pins within said bores and with each of said contact beams against each respective pin with a substantially high normal force against the respective pin and a relatively low insertion force throughout the entire insertion phase of the respective pin.

2. The electrical connector according to claim 1 wherein said second portion is molded within said insertion member.

3. The electrical connector according to claim 1, said receptacle further having a counter-sink bore in said top surface, said counter-sink bore in communication with said insertion bore and having a central counter-sink axis coincidental with said central insertion axis.

4. The electrical connector according to claim 1, said receptacle further comprising a beam loading ramp extending from at least one of said insertion surfaces, said beam loading ramp comprising a portion extending proximate said housing top and a portion extending toward said bottom surface to facilitate insertion of said connector beam in said retention bore.

5. The electrical connector of claim 1, said beam retention bore having a central beam retention axis, wherein said central beam retention axis is displaced from and parallel to said central insertion axis.

* * * * *